US011166600B2

(12) United States Patent
Blevins et al.

(10) Patent No.: US 11,166,600 B2
(45) Date of Patent: Nov. 9, 2021

(54) PORTABLE RESTROOM SYSTEM

(71) Applicants: Timothy Donald Blevins, DeKalb, TX (US); Clint Elliot Nelson, Winthrop, AR (US)

(72) Inventors: Timothy Donald Blevins, DeKalb, TX (US); Clint Elliot Nelson, Winthrop, AR (US)

( * ) Notice: Subject to any disclaimer, the term of this patent is extended or adjusted under 35 U.S.C. 154(b) by 0 days.

(21) Appl. No.: 17/006,381

(22) Filed: Aug. 28, 2020

(65) Prior Publication Data

US 2021/0059480 A1 Mar. 4, 2021

Related U.S. Application Data

(60) Provisional application No. 62/893,507, filed on Aug. 29, 2019.

(51) Int. Cl.

| | |
|---|---|
| ***E04H 1/12*** | (2006.01) |
| ***A47K 4/00*** | (2006.01) |
| ***F21V 33/00*** | (2006.01) |
| ***F21S 9/00*** | (2006.01) |

(52) U.S. Cl.

CPC ..... *A47K 4/00* (2013.01); *E04H 1/1216* (2013.01); *F21S 9/00* (2013.01); *F21V 33/004* (2013.01)

(58) Field of Classification Search

CPC ..... A47K 4/00; B60R 15/00–04; B61D 35/00–007; E04B 1/34305–3431; E04H 1/1216

See application file for complete search history.

(56) References Cited

U.S. PATENT DOCUMENTS

| | | | | |
|---|---|---|---|---|
| 9,234,360 | B2 * | 1/2016 | Van Overbeek | E04B 1/344 |
| 9,303,420 | B2 * | 4/2016 | van der Linde | A47K 11/02 |
| 9,605,424 | B2 * | 3/2017 | Bikker | E04B 1/34336 |
| 10,724,259 | B2 * | 7/2020 | Schimmel | A47K 3/325 |
| 2004/0040081 | A1 * | 3/2004 | Ostbo | A47K 11/02 4/449 |

FOREIGN PATENT DOCUMENTS

| | | | | |
|---|---|---|---|---|
| EP | 3150781 | * | 4/2017 | E04H 1/12 |
| GB | 2432853 | * | 6/2007 | E04H 1/12 |

* cited by examiner

*Primary Examiner* — David P Angwin
*Assistant Examiner* — Nicholas A Ros

(57) ABSTRACT

A portable restroom system provides multiple restroom units and an arrangement which allows the size of the system to be reduced for easy storage and transportation. The system includes a first restroom array, a second restroom array, a water-supply manifold, and a waste-removal manifold. The first restroom array and the second restroom array each preferably provide at least four restroom units. The first restroom array and the second restroom array are structurally arranged to allow retractability of the walls, the ceilings, and the floors of the restroom units in order to allow the system to be easily stored and transported when not in use. The water-supply manifold provides clean water to the associated restroom units of the first restroom array and the second restroom array. The waste-removal manifold removes any waste produced after use of the associated restroom units of the first restroom array and the second restroom array.

19 Claims, 12 Drawing Sheets

PORTABLE RESTROOM SYSTEM

The current application claims a priority to the U.S. Provisional Patent application Ser. No. 62/893,507 filed on Aug. 29, 2019.

FIELD OF THE INVENTION

The present invention relates generally to portable restrooms. More specifically, the present invention is a portable restroom system comprising a plurality of restroom units. The arrangement of the present invention allows the overall size of the present invention to be reduced. In this way, multiple portable restroom systems can be transported or stored with ease.

BACKGROUND OF THE INVENTION

Portable restrooms are generally composed of a portable enclosure containing a chemical or holding tank-type toilet. The portable restrooms are commonly rented and used for special events such as parties, festivals, concerts, construction sites, outdoor sporting events, and other locations where people gather temporarily or infrequently. The portable restrooms are generally durable, constructed out of a lightweight molded plastic. Portable restrooms can be classified into two main categories, i.e., single-unit portable restrooms and multi-unit portable restrooms. Single unit portable restrooms are designed for use by a single occupant. Multi-unit portable restrooms include a plurality of individual restroom units that share a common wastewater holding tank.

The portable restrooms can be grouped together on a portable restroom trailer to be transported from one location to another. However, the existing single-unit or multi-unit portable restrooms require a lot of space for transportation. Moreover, the storage of the existing single-unit or multi-unit portable restrooms is usually problematic due to the space requirement. Therefore, a limited number of portable restrooms can be stored in a given area or transported using a single trailer. The present invention aims to solve some of these problems by disclosing a portable restroom system which comprises a plurality of restroom units and is able to reduce the overall footprint during storage and transportation.

DETAIL DESCRIPTIONS OF THE INVENTION

Figure 1:
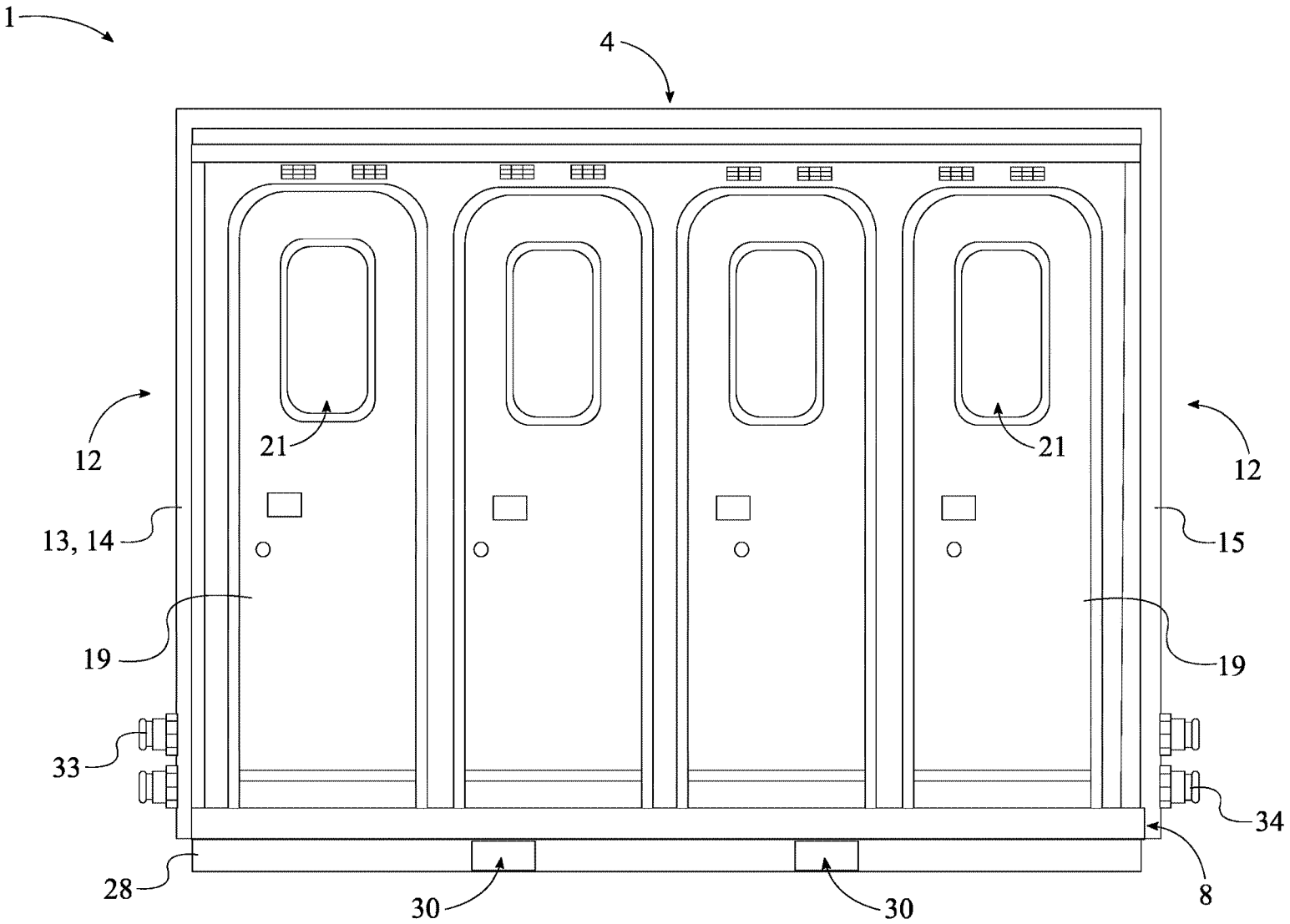
FIG. 1 is a front view of the present invention displaying the first restroom array.

All illustrations of the drawings are for the purpose of describing selected versions of the present invention and are not intended to limit the scope of the present invention.

In reference to FIGS. 1 through 12, the present invention is a portable restroom system that provides multiple restroom units and an arrangement which allows the size of the present invention to be reduced for easy storage and transportation. A preferred embodiment of the present invention comprises a first restroom array 1, a second restroom array 2, a water-supply manifold 25, and a waste-removal manifold 26. The first restroom array 1 and the second restroom array 2 each preferably provide at least four restroom units. The first restroom array 1 and the second restroom array 2 are structurally arranged to allow retractability of the walls, the ceilings, and the floors of the associated restroom units in order to allow the present invention to be easily stored and transported when not in use. The water-supply manifold 25 provides clean water to the associated restroom units of the first restroom array 1 and the second restroom array 2. The waste-removal manifold 26 removes any waste produced after use of the associated restroom units of the first restroom array 1 and the second restroom array 2.

The general configuration of the aforementioned components allows the present invention to provide multiple restroom units which can reduced in size for easy storage and transportation. With reference to FIGS. 1 through 4, the first restroom array 1 and the second restroom array 2 each comprise a backwall 3, a telescopic floor 8, a telescopic ceiling 4, a plurality of telescopic sidewalls 12, a plurality of doors 19, and a plurality of portable toilets 20. The backwall 3, the telescopic floor 8, the telescopic ceiling 4, two sidewalls from the plurality of sidewalls, one door from the plurality of doors 19, and one portable toilet from the plurality of portable toilets 20 structurally form one restroom unit of the present invention. The telescopic floor 8, the telescopic ceiling 4, and each of the plurality of telescopic sidewalls 12 can be retracted in order to allow for easy storage and transportation of the present invention. The plurality of telescopic sidewalls 12 comprises a plurality of other telescopic sidewalls 13 and a last telescopic sidewall 15. The last telescopic sidewall 15 is one of two sidewalls which is positioned at the exterior of the first restroom array 1 and the second restroom array 2. The backwall 3 of the first restroom array 1 is mounted parallel and offset from the backwall 3 of the second restroom array 2. This arrangement physically separates the associated restroom units of the first restroom array 1 from the associated restroom units of the second restroom array 2.

Figure 5:
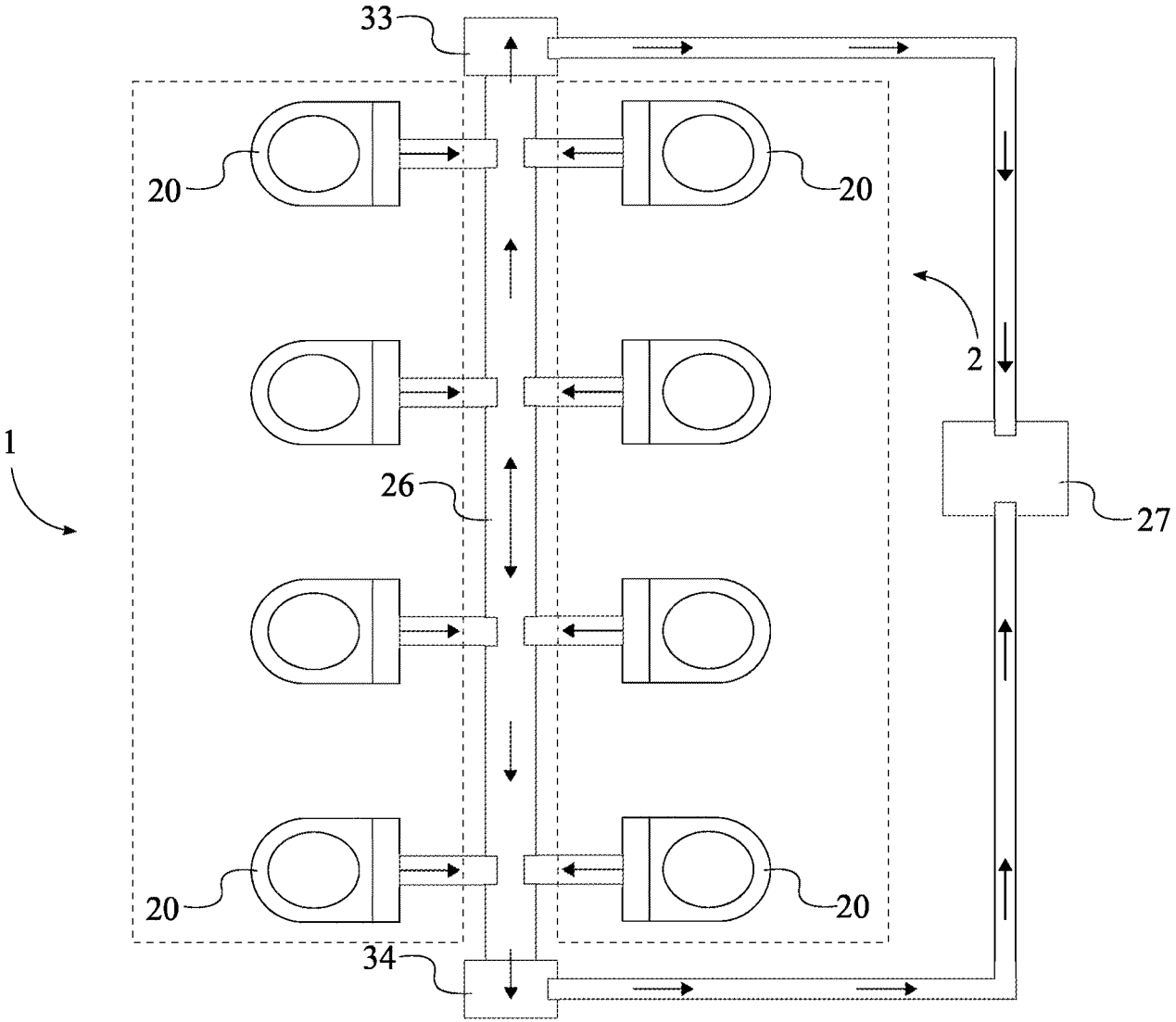
FIG. 5 is a schematic diagram illustrating the fluid communication between the plurality of portable toilets and the waste-removal manifold.
Figure 6:
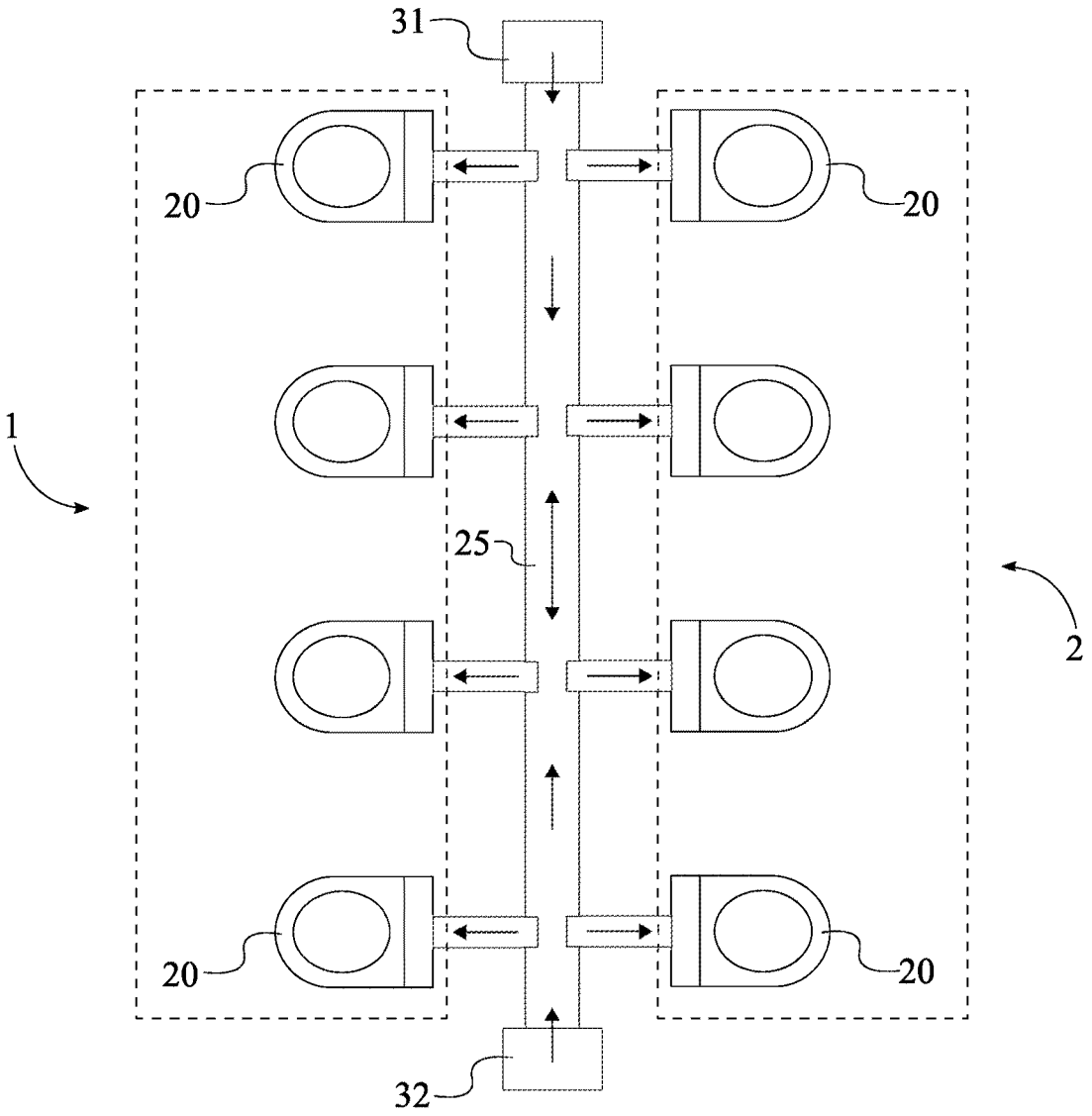
FIG. 6 is a schematic diagram illustrating the fluid communication between the plurality of portable toilets and the water-supply manifold.

The following arrangements structurally form each of the restroom units of the present invention. With reference to FIGS. 1 through 4, the telescopic floor 8 is connected adjacent to the backwall 3, and the telescopic ceiling 4 is connected adjacent to the backwall 3, opposite the telescopic floor 8. This arrangement structurally defines the ceiling and the floor for each restroom unit. Further, the plurality of telescopic sidewalls 12 is positioned in between the telescopic floor 8 and the telescopic ceiling 4, and the plurality of telescopic sidewalls 12 is connected adjacent and across the backwall 3. This arrangement structurally defines two sidewalls for each restroom unit. Moreover, each of the plurality of doors 19 is hingedly connected adjacent to a corresponding other telescopic sidewall from the plurality of other telescopic sidewalls 13, opposite to the backwall 3. In further detail, this arrangement provides one door from the plurality of doors 19 for each restroom unit. The plurality of portable toilets 20 is mounted against the backwall 3 and is interspersed amongst the plurality of telescopic sidewalls 12. In further detail, a plurality of toilet mounts is used to mount a corresponding portable toilet onto the telescopic floor 8 and against the backwall 3. This arrangement provides one portable toilet from the plurality of portable toilets 20 for each restroom unit. With reference to FIGS. 5 and 6, each of the plurality of portable toilets 20 of the first restroom array 1 and each of the plurality of portable toilets 20 from the second restroom array 2 are in fluid communication with the water-supply manifold 25 and the waste-removal manifold 26. In further detail, piping is run from each of the plurality of portable toilets 20, through the area between the backwall 3 of the first restroom array 1 and the backwall 3, and to the water-supply manifold 25 and the waste-removal manifold 26 in order to establish the fluid communication between each of the plurality of portable toilets 20 and the water-supply manifold 25 and the waste-removal manifold 26. This arrangement allows the water-supply manifold 25 to supply clean water to each of the plurality of portable toilets 20 after use and allows the waste-removal manifold 26 to remove any waste from the plurality of portable toilets 20 after use.

Figure 7:
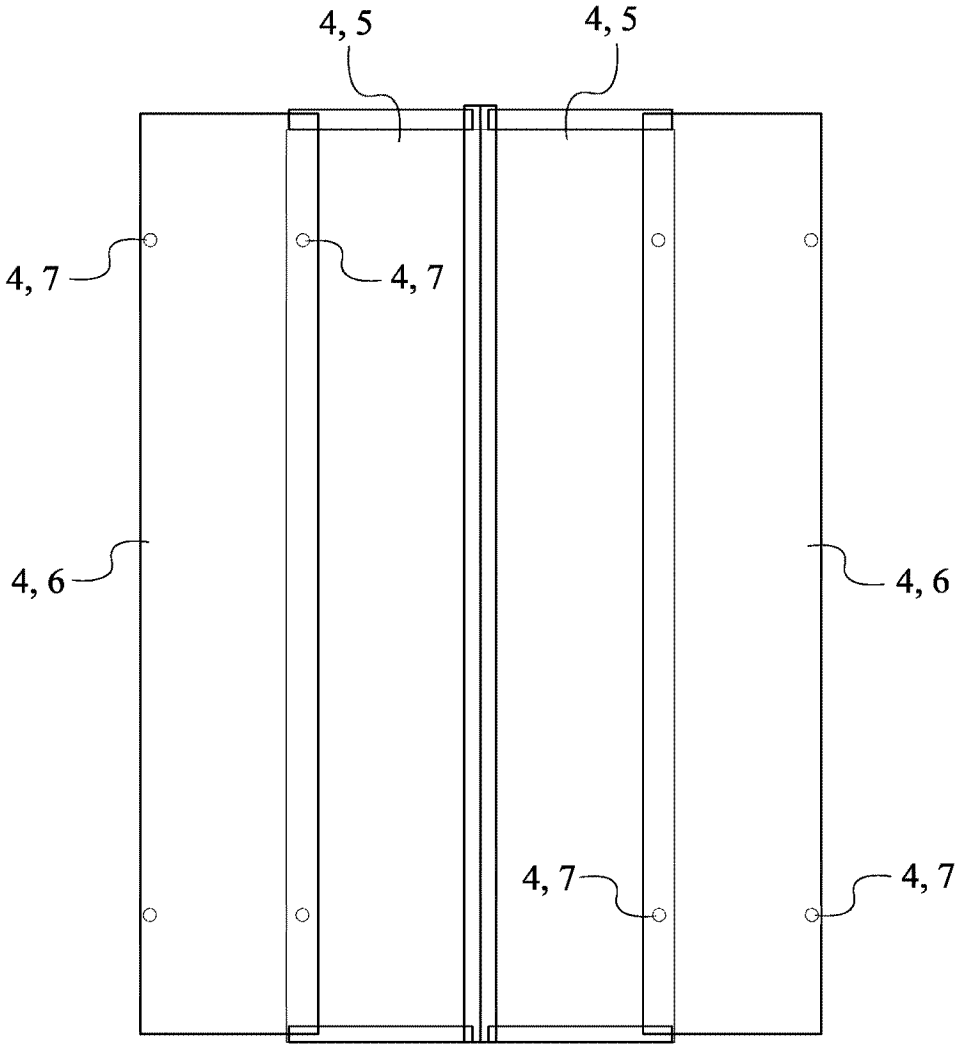
FIG. 7 is a top view displaying the telescopic ceiling.

In order for the telescopic ceiling 4 to be retracted and extended and with reference to FIG. 7, the telescopic ceiling 4 may further comprise a fixed ceiling panel 5, an extension ceiling panel 6, and a ceiling-locking mechanism 7. The backwall 3 is positioned adjacent to the fixed ceiling panel 5. This arrangement permanently secures the fixed ceiling panel 5 to the backwall 3. The extension ceiling panel 6 is slidably connected onto the fixed ceiling panel 5, opposite the backwall 3. Any means can be used to establish the slidable connection between the fixed ceiling panel 5 and the extension ceiling panel 6. However, in the preferred embodiment, the slidable connection is established through a rail and caster system. This arrangement allows the extension ceiling panel 6 to be retracted towards the backwall 3 or extended away from the backwall 3. The ceiling-locking mechanism 7 is operatively integrated into the slidable connection between the fixed ceiling panel 5 and the extension ceiling panel 6. The ceiling-locking mechanism 7 is used to selectively secure the extension ceiling panel 6 in place with the fixed ceiling panel 5 in between a deployed configuration and an undeployed configuration. Any type of locking mechanism can be used as the ceiling-locking mechanism 7. However, in the preferred embodiment, the ceiling-locking mechanism 7 comprises a set of deployed pinholes, a set of undeployed pinholes, and a locking pin. The deployed configuration is when the extension ceiling panel 6 is extended away from the backwall 3 and the present invention is in use. For the deployed configuration in the preferred embodiment, the locking pin is inserted into the set of deployed pinholes in order to prevent the extension ceiling panel 6 from sliding out of the deployed configuration. The undeployed configuration is when the extension ceiling panel 6 is retracted towards the backwall 3 and the present invention is not in use. For the undeployed configuration in the preferred embodiment, the locking pin is inserted into the set of undeployed pinholes in order to prevent the extension ceiling panel 6 from sliding out of the undeployed configuration.

Figure 3:
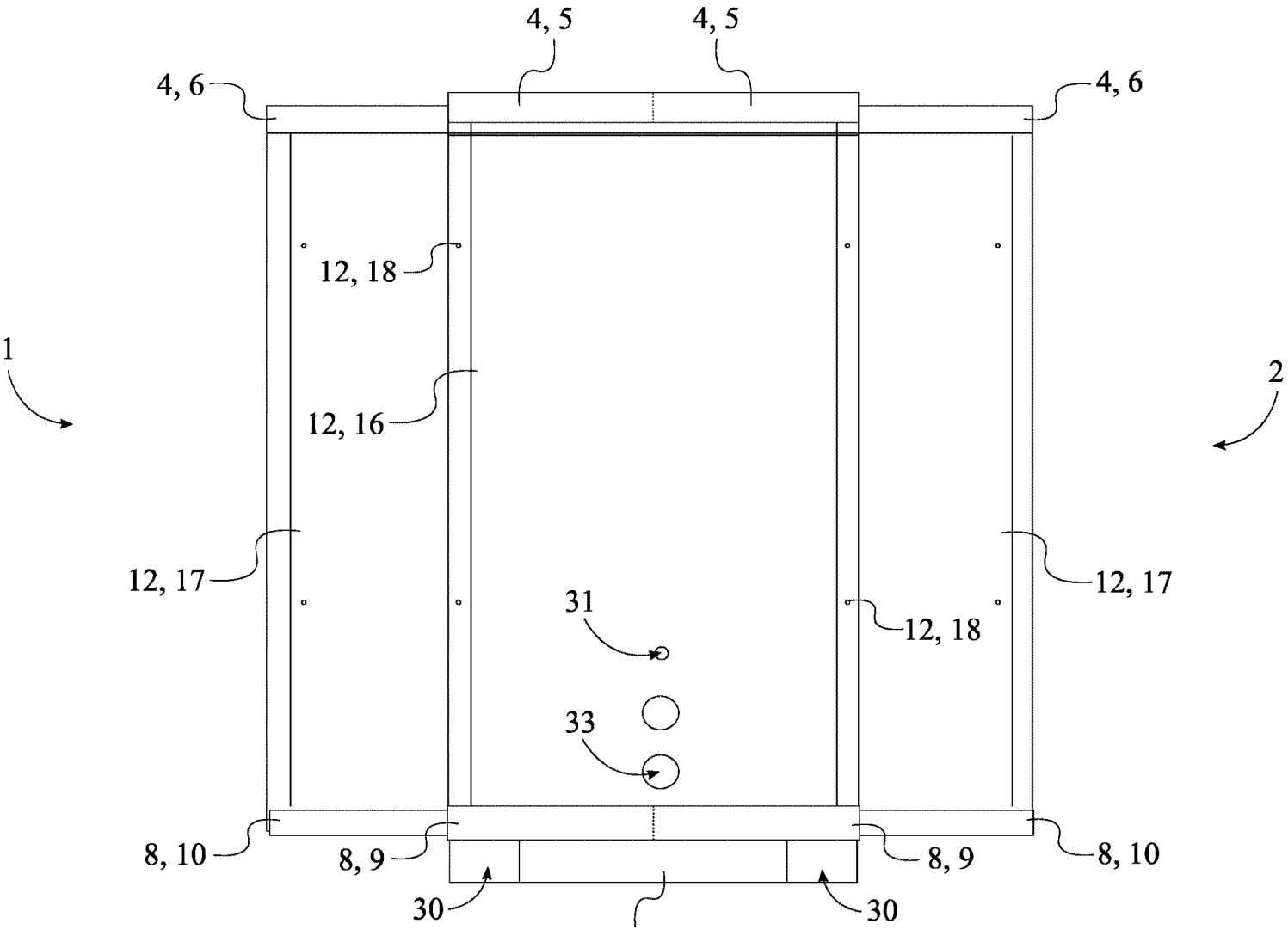
FIG. 3 is a left-side view of the present invention.

With reference to FIG. 3, the associated restroom units of the first restroom array 1 and the associated restroom units of the second restroom array 2 partially share the same ceiling. The fixed ceiling panel 5 of the first restroom array 1 and the fixed ceiling panel 5 of the second restroom array 2 are positioned coplanar to each other. Further, the fixed ceiling panel 5 of the first restroom array 1 is connected adjacent to the fixed ceiling panel 5 of the second restroom array 2. Thus, the associated restroom units of the first restroom array 1 and the associated restroom units of the second restroom array 2 share the same panel body as the fixed ceiling panel 5, but not the same extension ceiling panel 6.

Figure 8:
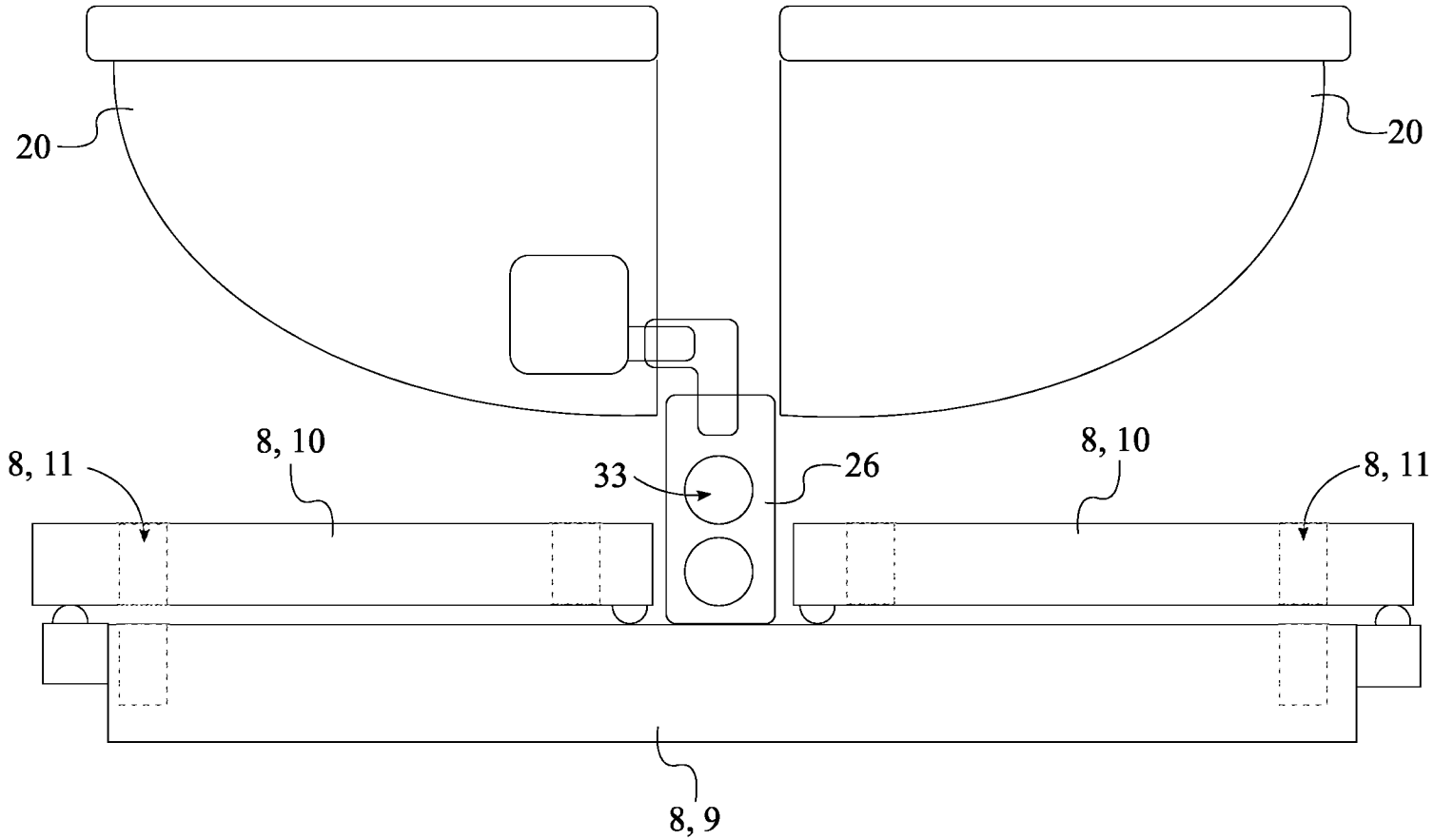
FIG. 8 is a side view displaying the telescopic floor and the plurality of portable toilets.

Similarly and in order for the telescopic floor 8 to be retracted and extended and with reference to FIG. 8, the telescopic floor 8 may further comprise a fixed floor panel 9, an extension floor panel 10, and a floor-locking mechanism 11. The backwall 3 is positioned adjacent to the fixed floor panel 9. This arrangement permanently secures the fixed floor panel 9 to the backwall 3. The extension floor panel 10 is slidably connected onto the fixed floor panel 9, opposite the backwall 3. Any means can be used to establish the slidable connection between the fixed floor panel 9 and the extension floor panel 10. However, in the preferred embodiment, the slidable connection is established through a rail and caster system. This arrangement allows the extension floor panel 10 to be retracted towards the backwall 3 or extended away from the backwall 3. The floor-locking mechanism 11 is operatively integrated into the slidable connection between the fixed floor panel 9 and the extension floor panel 10. The floor-locking mechanism 11 is used to selectively secure the extension floor panel 10 in place with the fixed floor panel 9 in between a deployed configuration and an undeployed configuration. Any type of locking mechanism can be used as the floor-locking mechanism 11. However, in the preferred embodiment, the floor-locking mechanism 11 comprises a set of deployed pinholes, a set of undeployed pinholes, and a locking pin. The deployed configuration is when the extension floor panel 10 is extended away from the backwall 3 and the present invention is in use. For the deployed configuration in the preferred embodiment, the locking pin is inserted into the set of deployed pinholes in order to prevent the extension floor panel 10 from sliding out of the deployed configuration. The undeployed configuration is when the extension floor panel 10 is retracted towards the backwall 3 and the present invention is not in use. For the undeployed configuration in the preferred embodiment, the locking pin is inserted into the set of undeployed pinholes in order to prevent the extension floor panel 10 from sliding out of the undeployed configuration.

With reference to FIG. 3, the associated restroom units of the first restroom array 1 and the associated restroom units of the second restroom array 2 partially share the same floor. The fixed floor panel 9 of the first restroom array 1 and the fixed floor panel 9 of the second restroom array 2 are positioned coplanar to each other. Further, the fixed floor panel 9 of the first restroom array 1 is connected adjacent to the fixed floor panel 9 of the second restroom array 2. Thus, the associated restroom units of the first restroom array 1 and the associated restroom units of the second restroom array 2 share the same panel body as the fixed floor panel 9, but not the same extension floor panel 10.

Similar to the telescopic ceiling 4 and the telescopic floor 8, in order for each of the plurality of telescopic sidewalls 12 to be retracted and extended and with reference to FIG. 3, each of the plurality of telescopic sidewalls 12 may further comprise a fixed wall panel 16, an extension wall panel 17, and a wall-locking mechanism 18. The backwall 3 is positioned adjacent to the fixed wall panel 16. This arrangement permanently secures the fixed wall panel 16 to the backwall 3. The extension wall panel 17 is slidably connected onto the fixed wall panel 16, opposite the backwall 3. Any means can be used to establish the slidable connection between the fixed wall panel 16 and the extension wall panel 17. However, in the preferred embodiment, the slidable connection is established through a rail and caster system. This arrangement allows the extension wall panel 17 to be retracted towards the backwall 3 or extended away from the backwall 3. The wall-locking mechanism 18 is operatively integrated into the slidable connection between the fixed wall panel 16 and the extension wall panel 17. The wall-locking mechanism 18 is used to selectively secure the extension wall panel 17 in place with the fixed wall panel 16 in between a deployed configuration and an undeployed configuration. Any type of locking mechanism can be used as the wall-locking mechanism 18. However, in the preferred embodiment, the wall-locking mechanism 18 comprises a set deployed pinholes, a set undeployed pinholes, and a locking pin. The deployed position is when the extension wall panel 17 is extended away from the backwall 3 and the present invention is in use. For the deployed configuration in the preferred embodiment, the locking pin is inserted into the set of deployed pinholes in order to prevent the extension wall panel 17 from sliding out of the deployed configuration. The undeployed position is when the extension wall panel 17 is retracted towards the backwall 3 and the present invention is not in use. For the undeployed configuration in the preferred embodiment, the locking pin is inserted into the set of undeployed pinholes in order to prevent the extension wall panel 17 from sliding out of the undeployed configuration.

Figure 4:
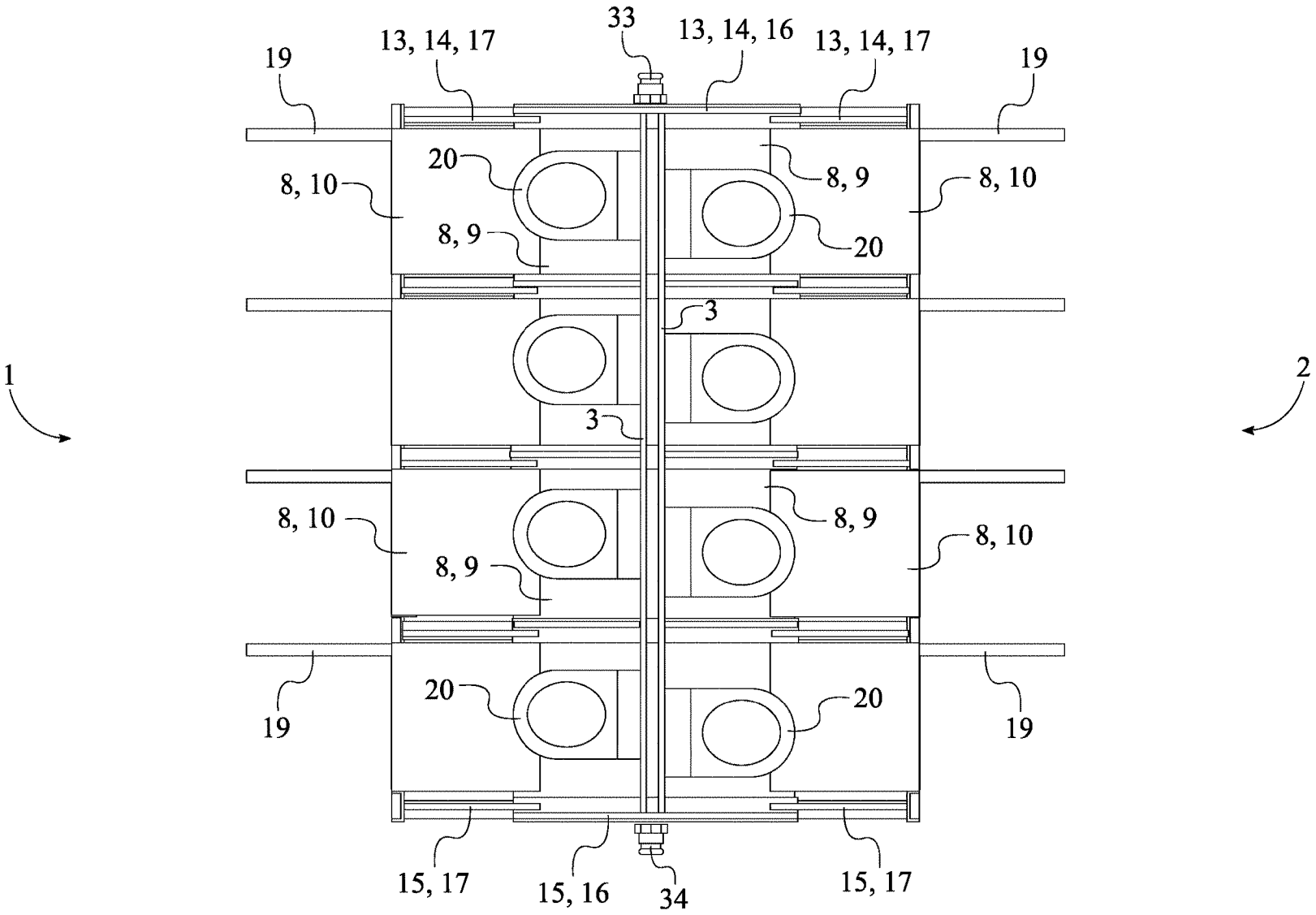
FIG. 4 is a top view of the present invention without the telescopic ceiling.

And with reference to FIG. 4, the associated restroom units of the first restroom array 1 and the associated restroom units of the second restroom array 2 partially share two of the same sidewalls. The plurality of other telescopic sidewalls 13 comprises an initial telescopic sidewall 14. The initial telescopic sidewall 14 is the first sidewall in the sequence of the plurality of telescopic sidewalls 12 and the second of two sidewalls which is at the exterior of the first restroom array 1 and the second restroom array 2. The fixed wall panel 16 of the initial telescopic sidewall 14 of the first restroom array 1 and the fixed wall panel 16 of the initial telescopic sidewall 14 of the second restroom array 2 are positioned coplanar to each other. Further, the fixed wall panel 16 of the initial telescopic sidewall 14 of the first restroom array 1 is connected adjacent to the fixed wall panel 16 of the initial telescopic sidewall 14 of the second restroom array 2. Thus, the associated restroom units of the first restroom array 1 and the associated restroom units of the second restroom array 2 share the same panel body as the fixed wall panel 16 of the initial telescopic sidewall 14. Similarly, the fixed wall panel 16 of the last telescopic sidewall 15 of the first restroom array 1 and the fixed wall panel 16 of the last telescopic sidewall 15 of the second restroom array 2 are positioned coplanar to each other. Further, the fixed wall panel 16 of the last telescopic sidewall 15 of the first restroom array 1 is connected adjacent to the fixed wall panel 16 of the last telescopic sidewall 15 of the second restroom array 2. Thus, the associated restroom units of the first restroom array 1 and the associated restroom units of the second restroom array 2 share the same panel body as the fixed wall panel 16 of the last telescopic sidewall 15.

In order for the waste-removal manifold 26 to effectively remove waste from the associated portable toilet of each restroom unit and with reference to FIG. 5, the present invention may further comprise at least one vacuum pump 27. The vacuum pump 27 is externally positioned to the first restroom array 1. Thus, the vacuum pump 27 is positioned between the first restroom array 1 and a wastewater tank. The plurality of portable toilets 20 from the first restroom array 1 is in fluid communication with the vacuum pump 27 by the waste-removal manifold 26. In further detail, this arrangement allows the vacuum pump 27 to suction out waste after a portable toilet from the first restroom array 1 is used. Similarly, the vacuum pump 27 is externally positioned to the second restroom array 2. Thus, the vacuum pump 27 is positioned between the second restroom array 2 and a wastewater tank. The plurality of portable toilets 20 from the second restroom array 2 is in fluid communication with the vacuum pump 27 by the waste-removal manifold 26. In further detail, this arrangement allows the vacuum pump 27 to suction out waste after a portable toilet from the second restroom array 2 is used.

Figure 2:
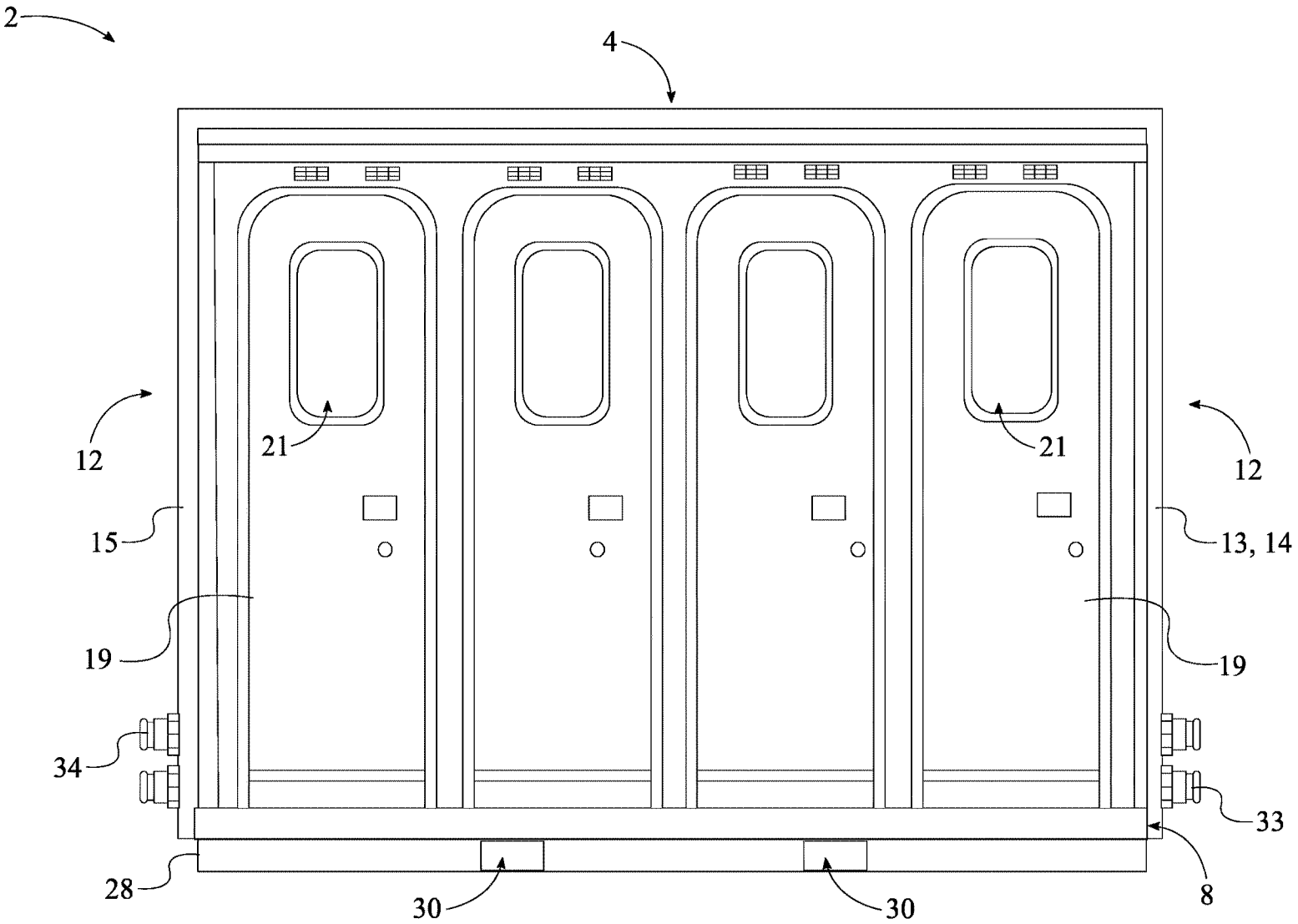
FIG. 2 is a rear view of the present invention displaying the first restroom array.

In order to provide natural light to each restroom unit while still providing privacy and with reference to FIGS. 1 and 2, the first restroom array 1 and the second restroom array 2 each further comprise a plurality of obscure-glass windows 21. Each of the plurality of obscure-glass windows 21 is integrated into a corresponding door from the plurality of doors 19. Thus, each restroom unit is provided with an obscure-glass window. The obscure-glass window allows light to shine into each restroom unit while preventing individuals from seeing the inside of a restroom unit from outside.

Figure 9:
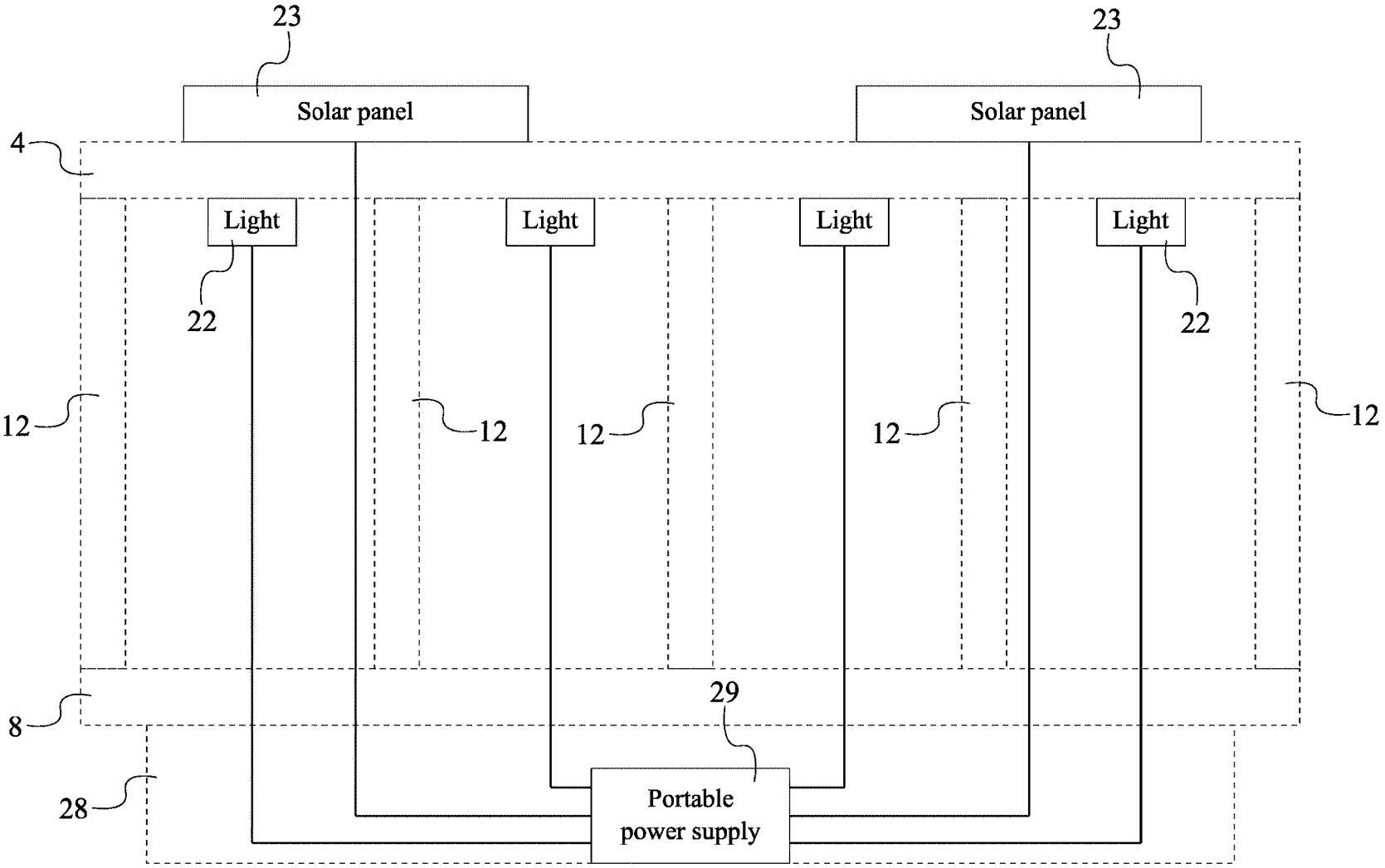
FIG. 9 is a schematic diagram illustrating the electrical connections of the present invention.

In order to provide stabilization to the telescopic floor 8 of the first restroom array 1 and the telescopic floor 8 of the second restroom array 2 and to provide electrical power to each restroom unit and with reference to FIG. 9, the present invention may further comprise a structural base 28 and a portable power supply 29. The telescopic floor 8 of the first restroom array 1 and the telescopic floor 8 of the second restroom array 2 are mounted onto the structural base 28. Thus, the structural base 28 provides stabilization to the fixed floor panel 9. Further, the portable power supply 29 is mounted within the structural base 28. This arrangement protects and conceals the portable power supply 29. In the preferred embodiment, the portable power supply 29 is a rechargeable battery system.

In order to provide electrical lighting to each restroom unit and with reference to FIG. 9, the first restroom array 1 and the second restroom array 2 may each further comprise a plurality of lights 22. The plurality of lights 22 is mounted onto the telescopic ceiling 4 and is interspersed amongst the plurality of telescopic sidewalls 12. Thus, there is one light from the plurality of lights 22 for each restroom unit. The plurality of lights 22 of the first restroom array 1 and the plurality of lights 22 of the second restroom array 2 are electrically connected to the portable power supply 29. Thus, electrical power is transferred to each of the plurality of lights 22. In further detail, wiring is run from the portable power supply 29, through the structural base 28, through the backwall 3 of the first restroom array 1 and the backwall 3 of the second restroom array 2, through the fixed ceiling panel 5, and to each of the plurality of lights 22.

In order for the portable power supply 29 to be electrically charged by solar power and with reference to FIG. 9, the first restroom array 1 and the second restroom array 2 may each further comprise at least one solar panel 23. The at least one solar panel 23 is externally mounted onto the telescopic ceiling 4. This arrangement allows rays from the sun to reach the at least one solar panel 23. Further, the at least one solar panel 23 of the first restroom array 1 and the at least one solar panel 23 of the second restroom array 2 are electrically connected to the portable power supply 29. In further detail, solar energy is gathered by the at least one solar panel 23, and a solar controller converts the solar energy into electrical energy to safely charge the portable power supply 29. Wiring is run from the portable power supply 29, through the structural base 28, through the backwall 3 of the first restroom array 1 and the backwall 3 of the second restroom array 2, through the fixed ceiling panel 5, and to the at least one solar panel 23.

In order to allow the present invention to be easily transported by a forklift and with reference to FIGS. 1 and 2, the present invention may further comprise a plurality of forklift-engaging features 30. The plurality of forklift-engaging features 30 is laterally integrated into the structural base 28. In further detail, the forklift-engaging features includes a set of forklift pockets to receive the tongs of a forklift. The plurality of forklift-engaging features 30 is distributed about the structural base 28. This arrangement allows a forklift to engage the present invention from any side for convenience.

In order for each restroom unit to receive clean water from a water tank and with reference to FIG. 6, the present invention may further comprise a first water-supply inlet 31. The first water-supply inlet 31 is integrated into the initial telescopic sidewall 14. In further detail, the first water-supply inlet 31 is a hole, traversing into the initial telescopic sidewall 14, that can receive a pipe. The first water-supply inlet 31 is in fluid communication with each of the plurality of portable toilets 20 of the first restroom array 1 by the water-supply manifold 25, and the first water-supply inlet 31 is in fluid communication with each of the plurality of portable toilets 20 of the second restroom array 2 by the water-supply manifold 25. Thus, clean water can flow from a water tank, through the first water-supply inlet 31, through the water-supply manifold 25, and to each restroom unit.

Similarly and in order for each restroom unit to receive clean water from a water tank and with reference to FIG. 6, the present invention may further comprise a second water-supply inlet 32. The second water-supply inlet 32 is integrated into the last telescopic sidewall 15. In further detail, the second water-supply inlet 32 is a hole, traversing into the last telescopic sidewall 15, that can receive a pipe. The second water-supply inlet 32 is in fluid communication with each of the plurality of portable toilets 20 of the first restroom array 1 by the water-supply manifold 25, and the second water-supply inlet 32 is in fluid communication with each of the plurality of portable toilets 20 of the second restroom array 2 by the water-supply manifold 25. Thus, clean water can flow from a water tank, through the second water-supply inlet 32, through the water-supply manifold 25, and to each restroom unit. Moreover, the first water-supply inlet 31 and the second water-supply inlet 32 allows each restroom unit to have easy access to clean water from opposing sides of the present invention.

In order for wastewater to be removed from each restroom unit and with reference to FIGS. 1 and 5, the present invention may further comprise at least one first waste-removal outlet 33. The at least one first waste-removal outlet 33 is integrated into the initial telescopic sidewall 14. In further detail and in the preferred embodiment, the at least one first waste-removal outlet 33 is a camlock fitting that traverses into the initial telescopic sidewall 14. The camlock fitting includes internal baffles to consolidate the vacuum suction provided by the vacuum pump 27. The at least one first waste-removal outlet 33 is in fluid communication with each of the plurality of portable toilets 20 of the first restroom array 1 by the waste-removal manifold 26, and the at least one first waste-removal outlet 33 is in fluid communication with each of the plurality of portable toilets 20 of the second restroom array 2 by the waste-removal manifold 26. Thus, wastewater can flow from each restroom unit, through the waste-removal manifold 26, through the at least one first waste-removal outlet 33, and to a wastewater tank.

Similarly and in order for wastewater to be removed from each restroom unit and with reference to FIGS. 1 and 5, the present invention may further comprise at least one second waste-removal outlet 34. The at least one second waste-removal outlet 34 is integrated into the initial telescopic sidewall 14. In further detail and in the preferred embodiment, the at least one second waste-removal outlet 34 is a camlock fitting that traverses into the initial telescopic sidewall 14. The camlock fitting includes internal baffles to consolidate the vacuum suction provided by the vacuum pump 27. The at least one second waste-removal outlet 34 is in fluid communication with each of the plurality of portable toilets 20 of the first restroom array 1 by the waste-removal manifold 26, and the at least one second waste-removal outlet 34 is in fluid communication with each of the plurality of portable toilets 20 of the second restroom array 2 by the waste-removal manifold 26. Thus, wastewater can flow from each restroom unit, through the waste-removal manifold 26, through the at least one second waste-removal outlet 34, and to a wastewater tank. Moreover, the at least one first waste-removal outlet 33 and the at least one second waste-removal outlet 34 allows each restroom unit to have easy access to waste removal from opposing sides of the present invention.

Figure 10:
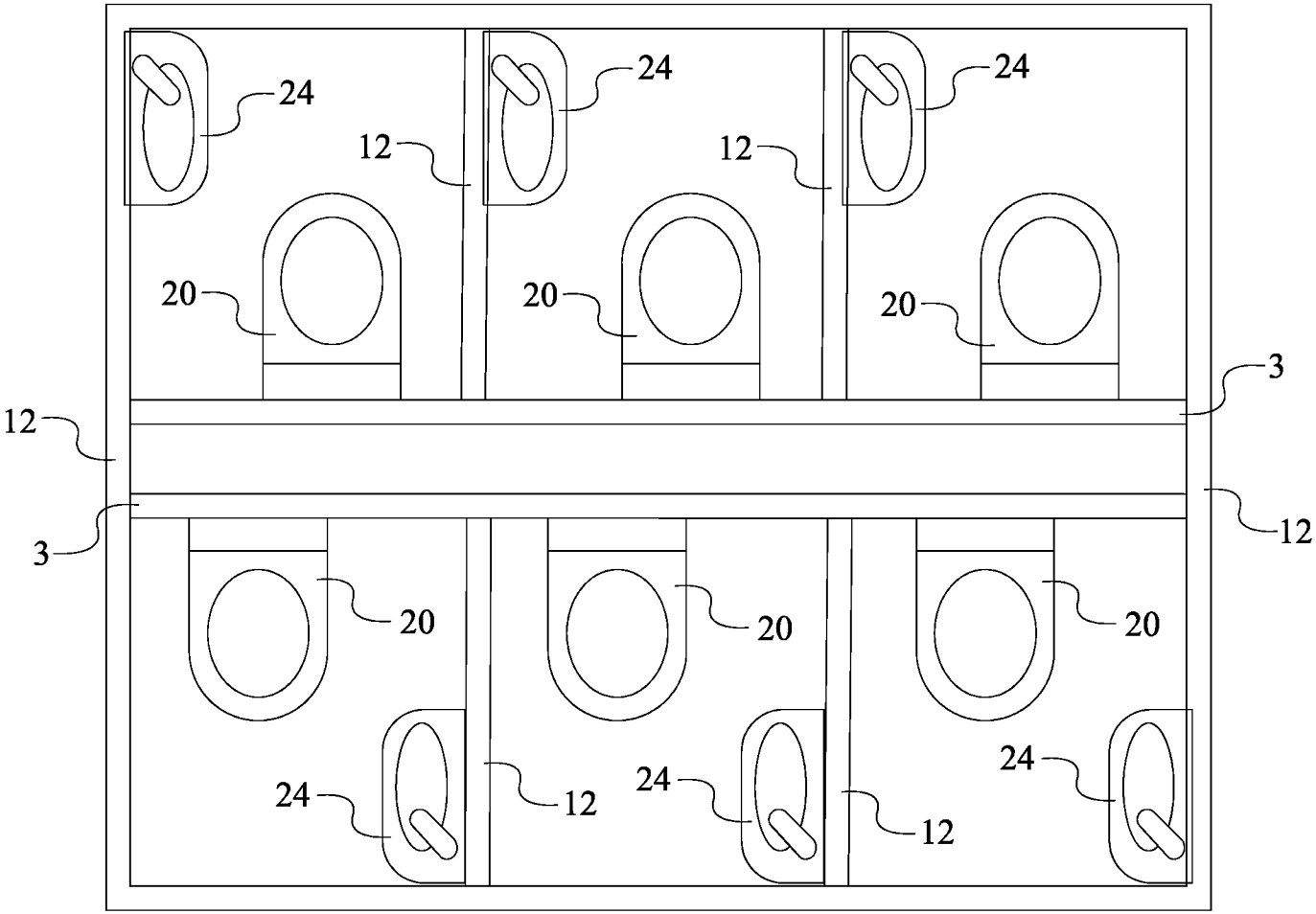
FIG. 10 is a top view of the present invention without the telescopic ceiling and displaying the plurality of portable sinks.
Figure 11:
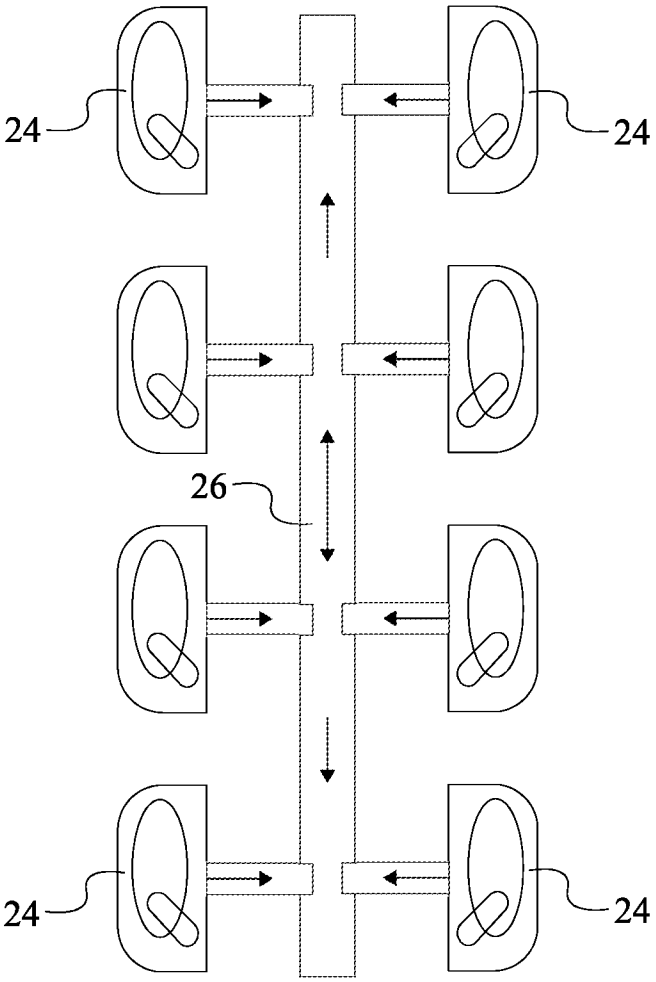
FIG. 11 is a schematic diagram illustrating the fluid communication between the plurality of portable sinks and the waste-removal manifold.
Figure 12:
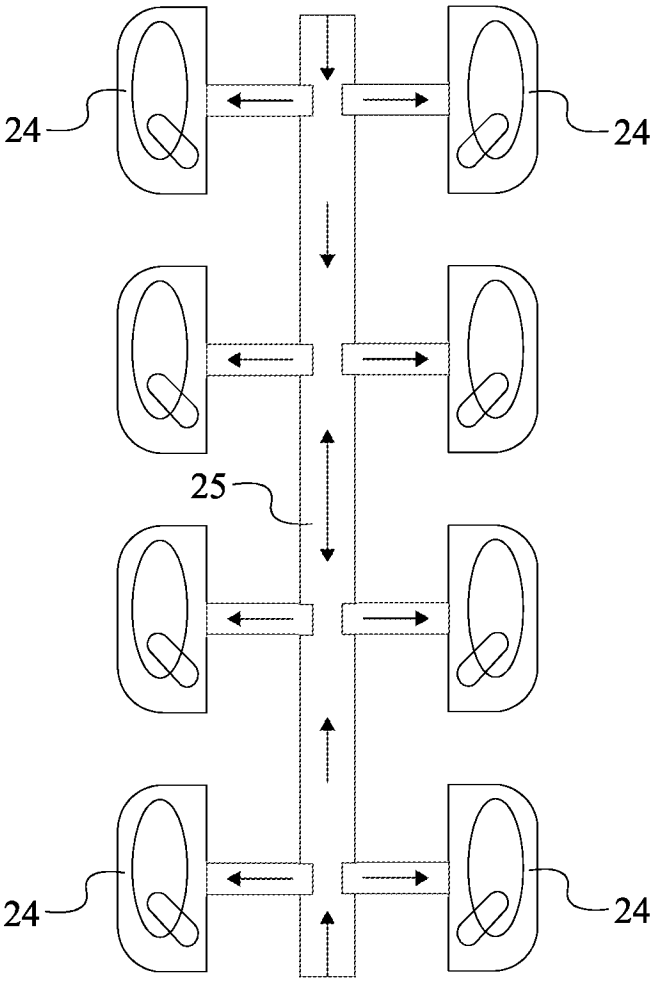
FIG. 12 is a schematic diagram illustrating the fluid communication between the plurality of portable sinks and the water-supply manifold.

In order to provide a means for an individual to wash his or her hands and with reference to FIG. 10, the present invention may further comprise a plurality of portable sinks 24. The plurality of portable sinks 24 is interspersed amongst the plurality of telescopic sidewalls 12. Thus, there is one portable sink for each restroom unit. With reference to FIGS. 11 and 12, each of the plurality of portable sinks 24 of the first restroom array 1 and each of the plurality of portable sinks 24 from the second restroom array 2 is in fluid communication with the water-supply manifold 25 and the waste-removal manifold 26. Thus, clean water and waste removal are provided for the portable sink of each restroom unit.

In another embodiment, first restroom array 1 and the second restroom array 2 each may each further comprise a plurality of automatic body-sensing lights. Each of the automatic body-sensing lights is integrated into a corresponding light from the plurality of lights. The structural components of the first restroom array 1 and the second restroom array 2 may be made of any suitable materials, such as metal or composite materials or using any suitable combination thereof. It should be understood that the components of the present invention may or may not be made of the same material. Further, it is envisioned that the size of the components forming the present invention such as the structural base 28, the plurality of telescopic sidewalls 12, the telescopic floor 8, the telescopic ceiling 4, and the backwall 3 can vary based on design requirements.

Although the invention has been explained in relation to its preferred embodiment, it is to be understood that many other possible modifications and variations can be made without departing from the spirit and scope of the invention as hereinafter claimed.

What is claimed is:

1. A portable restroom system comprises:

a first restroom array;

a second restroom array;

a water-supply manifold;

a waste-removal manifold;

the first restroom array and the second restroom array each comprise a backwall, a telescopic floor, a telescopic ceiling, a plurality of telescopic sidewalls, a plurality of doors, a plurality of portable toilets;

the plurality of telescopic sidewalls comprises a plurality of other telescopic sidewalls and a last telescopic sidewall;

the backwall of the first restroom array being mounted parallel and offset from the backwall of the second restroom array;

the telescopic floor being connected adjacent to the backwall;

the telescopic ceiling being connected adjacent to the backwall, opposite the telescopic floor;

the plurality of telescopic sidewalls being positioned in between the telescopic floor and the telescopic ceiling;

the plurality of telescopic sidewalls being connected adjacent and across the backwall;

each of the plurality of doors being hingedly connected adjacent to a corresponding other telescopic sidewall from the plurality of other telescopic sidewalls, opposite to the backwall;

the plurality of portable toilets being mounted against the backwall;

the plurality of portable toilets being interspersed amongst the plurality of telescopic sidewalls; and each of the plurality of portable toilets of the first restroom array and each of the plurality of portable toilets from the second restroom array being in fluid communication with the water-supply manifold and the waste-removal manifold.

2. The portable restroom system as claimed in claim 1 comprises:

at least one vacuum pump;

the vacuum pump being externally positioned to the first restroom array;

the plurality of portable toilets from the first restroom array being in fluid communication with the vacuum pump by the waste-removal manifold;

the vacuum pump being externally positioned to the second restroom array; and the plurality of portable toilets from the second restroom array being in fluid communication with the vacuum pump by the waste-removal manifold.

3. The portable restroom system as claimed in claim 1 comprises:

the first restroom array and the second restroom array each further comprise a plurality of obscure-glass windows; and each of the plurality of obscure-glass windows being integrated into a corresponding door from the plurality of doors.

4. The portable restroom system as claimed in claim 1 comprises:

a first water-supply inlet;

the plurality of other telescopic sidewalls comprises an initial telescopic sidewall;

the first water-supply inlet being integrated into the initial telescopic sidewall;

the first water-supply inlet being in fluid communication with each of the plurality of portable toilets of the first restroom array by the water-supply manifold; and the first water-supply inlet being in fluid communication with each of the plurality of portable toilets of the second restroom array by the water-supply manifold.

5. The portable restroom system as claimed in claim 1 comprises:

a second water-supply inlet;

the second water-supply inlet being integrated into the last telescopic sidewall;

the second water-supply inlet being in fluid communication with each of the plurality of portable toilets of the first restroom array by the water-supply manifold; and the second water-supply inlet being in fluid communication with each of the plurality of portable toilets of the second restroom array by the water-supply manifold.

6. The portable restroom system as claimed in claim 1 comprises:

at least one first waste-removal outlet;

the plurality of other telescopic sidewalls comprises an initial telescopic sidewall;

the at least one first waste-removal outlet being integrated into the initial telescopic sidewall;

the at least one first waste-removal outlet being in fluid communication with each of the plurality of portable toilets of the first restroom array by the waste-removal manifold; and the at least one first waste-removal outlet being in fluid communication with each of the plurality of portable toilets of the second restroom array by the waste-removal manifold.

7. The portable restroom system as claimed in claim 1 comprises:

at least one second waste-removal outlet;

the at least one second waste-removal outlet being integrated into the last telescopic sidewall;

the at least one second waste-removal outlet being in fluid communication with each of the plurality of portable toilets of the first restroom array by the waste-removal manifold; and the at least one second waste-removal outlet being in fluid communication with each of the plurality of portable toilets of the second restroom array by the waste-removal manifold.

8. The portable restroom system as claimed in claim 1 comprises:

the first restroom array and the second restroom array each further comprise a plurality of portable sinks;

the plurality of portable sinks being interspersed amongst the plurality of telescopic sidewalls; and each of the plurality of portable sinks of the first restroom array and each of the plurality of portable sinks from the second restroom array being in fluid communication with the water-supply manifold and the waste-removal manifold.

9. The portable restroom system as claimed in claim 1 comprises:

the telescopic ceiling comprises a fixed ceiling panel, an extension ceiling panel, and a ceiling-locking mechanism;

the backwall being positioned adjacent to the fixed ceiling panel;

the extension ceiling panel being slidably connected onto the fixed ceiling panel, opposite the backwall; and the ceiling-locking mechanism being operatively integrated into the slidable connection between the fixed ceiling panel and the extension ceiling panel, wherein the ceiling-locking mechanism is used to selectively secure the extension ceiling panel in place with the fixed ceiling panel in between a deployed configuration and an undeployed configuration.

10. The portable restroom system as claimed in claim 9 comprises:

the fixed ceiling panel of the first restroom array and the fixed ceiling panel of the second restroom array being positioned coplanar to each other; and the fixed ceiling panel of the first restroom array being connected adjacent to the fixed ceiling panel of the second restroom array.

11. The portable restroom system as claimed in claim 1 comprises:

the telescopic floor comprises a fixed floor panel, an extension floor panel, and a floor-locking mechanism;

the backwall being positioned adjacent to the fixed floor panel;

the extension floor panel being slidably connected onto the fixed floor panel, opposite the backwall; and the floor-locking mechanism being operatively integrated into the slidable connection between the fixed floor panel and the extension floor panel, wherein the wall-locking mechanism is used to secure the extension floor panel in place with the fixed floor panel in between a deployed configuration and an undeployed configuration.

12. The portable restroom system as claimed in claim 11 comprises:

the fixed floor panel of the first restroom array and the fixed floor panel of the second restroom array being positioned coplanar to each other; and the fixed floor panel of the first restroom array being connected adjacent to the fixed floor panel of the second restroom array.

13. The portable restroom system as claimed in claim 1 comprises:

each of the plurality of telescopic sidewalls comprises a fixed wall panel, an extension wall panel, and a wall-locking mechanism;

the backwall being positioned adjacent to the fixed wall panel;

the extension wall panel being slidably connected onto the fixed wall panel, opposite the backwall; and the wall-locking mechanism being operatively integrated into the slidable connection between the fixed wall panel and the extension wall panel, wherein the wall-locking mechanism is used to selectively secure the extension wall panel in place with the fixed wall panel in between a deployed configuration and an undeployed configuration.

14. The portable restroom system as claimed in claim 13 comprises:

the plurality of other telescopic sidewalls comprises an initial telescopic sidewall;

the fixed wall panel of the initial telescopic sidewall of the first restroom array and the fixed wall panel of the initial telescopic sidewall of the second restroom array being positioned coplanar to each other; and the fixed wall panel of the initial telescopic sidewall of the first restroom array being connected adjacent to the fixed wall panel of the initial telescopic sidewall of the second restroom array.

15. The portable restroom system as claimed in claim 13 comprises:

the fixed wall panel of the last telescopic sidewall of the first restroom array and the fixed wall panel of the last telescopic sidewall of the second restroom array being positioned coplanar to each other; and the fixed wall panel of the last telescopic sidewall of the first restroom array being connected adjacent to the fixed wall panel of the last telescopic sidewall of the second restroom array.

16. The portable restroom system as claimed in claim 1 comprises:

a structural base;

a portable power supply;

the telescopic floor of the first restroom array and the telescopic floor of the second restroom array being mounted onto the structural base; and the portable power supply being mounted within the structural base.

17. The portable restroom system as claimed in claim 16 comprises:

the first restroom array and the second restroom array each further comprise a plurality of lights;

the plurality of lights being mounted onto the telescopic ceiling;

the plurality of lights being interspersed amongst the plurality of telescopic sidewalls; and the plurality of lights of the first restroom array and the plurality of lights of the second restroom array being electrically connected to the portable power supply.

18. The portable restroom system as claimed in claim 16 comprises:

the first restroom array and the second restroom array each further comprise at least one solar panel;

the at least one solar panel being externally mounted onto the telescopic ceiling; and the at least one solar panel of the first restroom array and the at least one solar panel of the second restroom array being electrically connected to the portable power supply.

19. The portable restroom system as claimed in claim 16 comprises:

a plurality of forklift-engaging features;

the plurality of forklift-engaging features being laterally integrated into the structural base; and the plurality of forklift-engaging features being distributed about the structural base.

* * * * *